United States Patent [19]

Watkins

[11] Patent Number: 4,735,521

[45] Date of Patent: Apr. 5, 1988

[54] DRIVE APPARATUS FOR A PRINTER MECHANISM

[75] Inventor: Paul V. Watkins, Riverton, Wyo.

[73] Assignee: Eaton Corporation, Cleveland, Ohio

[21] Appl. No.: 50,114

[22] Filed: May 15, 1987

[51] Int. Cl.[4] ..... B41J 11/50

[52] U.S. Cl. ..... 400/608.1; 400/589; 400/607; 226/49

[58] Field of Search ..... 101/228; 226/49, 108; 400/584, 589, 592, 605–608.1, 608.2, 608.4

[56] References Cited

U.S. PATENT DOCUMENTS

| | | | |
|---|---|---|---|
| 4,205,770 | 6/1980 | Wojdyla | 400/608.1 X |
| 4,229,113 | 10/1980 | Anderson | 400/605 X |
| 4,417,825 | 11/1983 | Cushman | 400/608.1 X |
| 4,425,047 | 1/1984 | Narushima | 400/608 X |
| 4,639,154 | 1/1987 | Myers | 400/584 |

*Primary Examiner*—Paul T. Sewell

*Attorney, Agent, or Firm*—D. A. Rowe; M. L. Union

[57] ABSTRACT

A drive apparatus for a printer mechanism including a printhead comprises first and second print medium drive means for feeding first and second print mediums past the printhead, a main drive gear rotatable in a first direction for driving the first print medium drive means and rotatable in a second direction for driving the second print medium drive means, selectively engageable drive means alternately engageable with the first and second print medium drive means for driving the first print medium drive means in a first direction when the main drive gear is rotated in the first direction and driving the second print medium drive means in a second direction when the main drive gear is rotated in the second direction and locking means for locking the first print medium drive means when the main drive gear is rotated in the second direction.

12 Claims, 2 Drawing Sheets

DRIVE APPARATUS FOR A PRINTER MECHANISM

DESCRIPTION

Drive apparatus for a printer mechanism.

TECHNICAL FIELD

The present invention relates to a drive apparatus for a printer mechanism which includes a first print medium drive means for feeding a first print medium past a printhead and a second print medium drive means for feeding a second print medium past the printhead.

BACKGROUND

Printer mechanisms and drives for the print medium are well known in the prior art. In some of the known printer mechanisms, a separate motor is provided for energizing the first print medium drive and the second print medium drive. In other known prior art, a single motor is utilized to drive both the first and second print medium drive. An example of such a drive apparatus is disclosed in U.S. Pat. No. 4,639,154. Such a drive apparatus utilizes one-way clutches to effect rotation of selectively actuatable drive means for the print medium.

Some of the known prior art suffers from the disadvantage that electromechanical elements are utilized to lock one feedpath when switching to the other feedpath when using the same motor to drive both feedpaths. The electromechanical element, such as a locking solenoid, is necessary to prevent oscillation in the feedpaths due to motor oscillation and to prevent medium movement due to existing forces. Motor oscillation would tend to drive the print medium in both paths if one were not locked and accumulate error in the one path which was not desired to be driven. The use of the known electromechanical elements such as solenoids increases the size and cost of the known printer mechanisms.

DISCLOSURE OF THE INVENTION

The drive apparatus for a printer mechanism of the present invention includes first and second print medium drives for feeding a first and second print medium past the printhead, gear means alternately engageable with the first and second print medium drive means and a locking means engageable with the first print medium drive means for preventing rotation of the first print medium drive means when the second print medium drive means is driven.

Another provision of the present invention is to provide a drive apparatus for a printer mechanism including first and second print medium drive means for feeding first and second print mediums past the printhead, a main drive rotatable in a first direction for driving the first print medium drive means and rotatable in a second direction for driving the second print medium drive means, selectively engageable drive means operatively associated with the main drive means and alternately engageable with the first and second print medium drive means, the selectively engageable drive means drives the first print medium drive means in a first direction when the main drive is rotated in the first direction and drives the second print medium drive means in a second direction when the main drive is rotated in the second direction and a locking means engageable with the first print medium drive means for preventing rotation thereof when the main drive is rotated in the second direction to effect rotation of the second print medium drive means.

A further provision of the present invention is to provide a drive apparatus for a printer mechanism including a printer comprising first and second print medium drive means for feeding first and second print mediums, respectively, past the printhead, a main drive gear rotatable in a first direction for driving the first print medium drive means and rotatable in a second direction for driving the second print medium drive means, floating gear means operatively associated with the main drive gear and alternately engageable with the first and second print medium drive means. The floating gear means is operable to drive the first print medium drive means in the first direction when the main drive gear is rotated in a first direction and operable to drive the second print medium drive means in the second direction when the main drive gear is rotated in a second direction and wherein the main drive gear when rotated in the second direction prevents rotation of the first print medium drive means in the first and second directions.

A further provision of the present invention is to provide a new and improved drive apparatus for a printer mechanism a set forth in the preceding paragraph further including locking means operatively associated with the main drive gear and engageable with the first print medium drive means for preventing rotation of the first print medium drive means when the main drive gear is rotated in the second direction.

DESCRIPTION OF A PREFERRED EMBODIMENT

Figure 1:
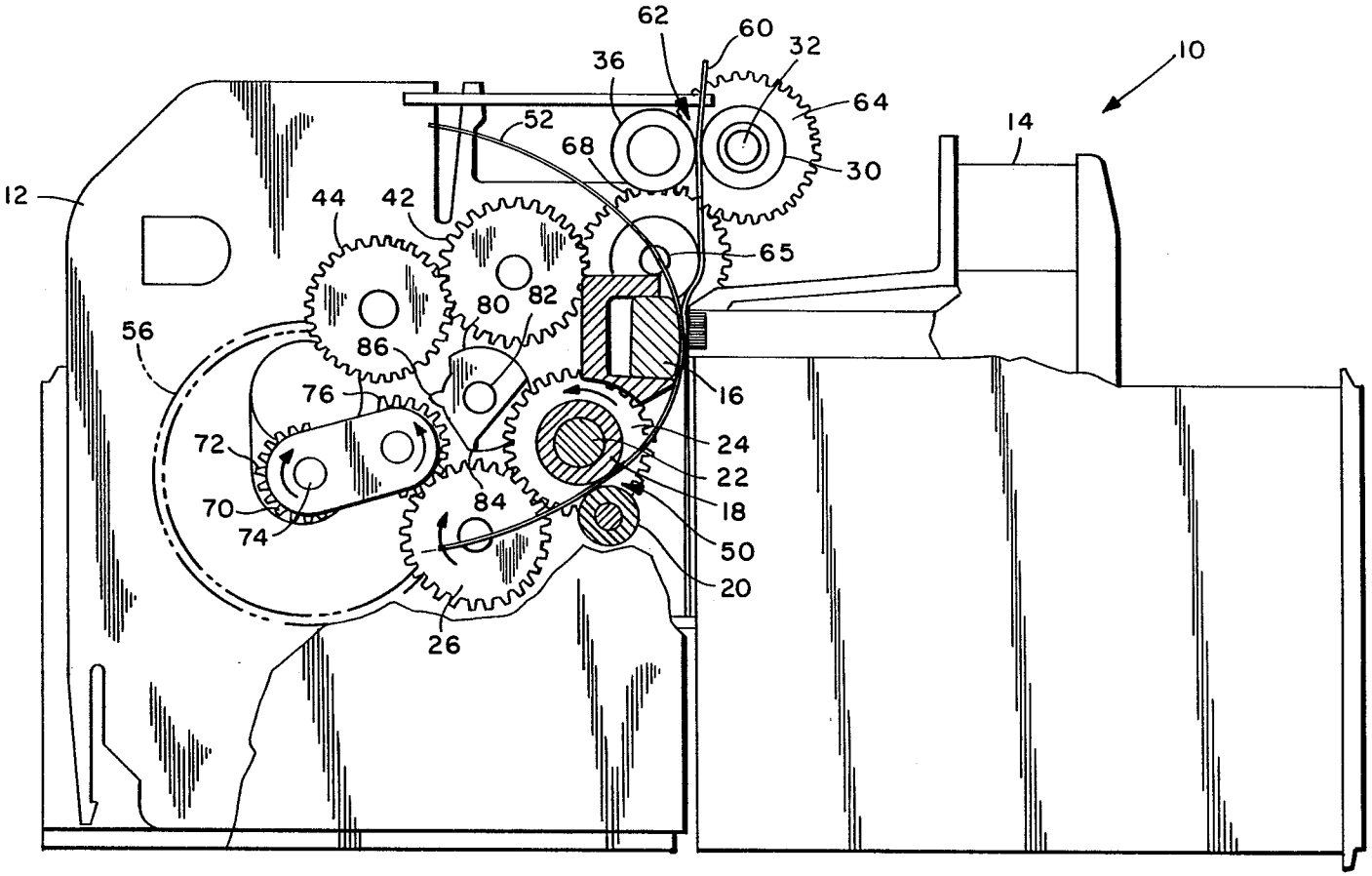
FIG. 1 is a schematic partially fragmentary cross-sectional view of the printer mechanism and drive apparatus therefore of the present invention wherein the main drive is rotated in a first direction and the interposer idler gear engages with and drives the paper drive means.

Referring generally to FIG. 1, a printer mechanism 10 is generally disclosed. The printer mechanism 10 is a mechanism which is operable to print on a pair of print media as will be more fully disclosed. The printer mechanism 10 includes a pair of support plates or side walls 12, one of which is disclosed in FIG. 1. The support plates 12 operate to support the drive mechanism and rollers of the printer mechanism 10 as will be more fully described.

The printer mechanism includes a printhead 14 and a platen 16. The printhead 14 is operable to print on a print medium which passes over the platen 16. A paper roller 18 is supported on a shaft 22 which in turn is supported by the support plates 12 of the printer mechanism 10. A paper feed gear 24 is disposed on shaft 22 and is operable to drive the paper roller 18. A paper pressure roller 20 is disposed parallel to the paper roller 18 and cooperates therewith to define a nip 50 through which a print medium is adapted to pass.

In the preferred embodiment, a supply of continuous print medium such as a roll of paper (not illustrated) is provided which is directed through the nip 50 between the paper roller 18 and the paper pressure roller 20. When the gear 24 is driven, the continuous paper supply, illustrated as 52 is driven through the nip 50 and across the surface of the platen 16 where it is adapted to be printed by the printhead 14 in a well known manner.

A paper feed idler gear 26 is supported for rotation on the frame 12 and engages with the paper feed gear 24 to drive paper roller 18. A stepper motor shown in phantom lines at 56 in FIG. 1 is operatively associated with the paper feed idler gear 26 and is operable to effect rotation of paper feed idler gear 26 as will be described more fully hereinbelow.

The printer mechanism 10 is adapted to print on the continuous print medium 52 and is additionally adapted to print on a non-continuous print medium such as a non-continuous form 60. A form feed roller 30 and a form feed pressure roller 36 cooperate to define a nip 62 therebetween through which a form 60 is adapted to be fed. The form feed roller 30 is supported on a shaft 32 which is supported in the sidewalls 12 of the printer mechanism 10. The form feed pressure roller 36 is supported in a position parallel to the form feed roller 30 and is adapted to move away from the form feed roller 30 to allow for the insertion of a form 60 in the nip 62 between the form feed pressure roller 36 and the form feed roller 30.

A gear 64 is supported on shaft 32 and is adapted to drive the form feed roller 30. Gear 64 engages with a gear 68 which is supported on a shaft 65 supported on the sidewall 12. The gear 68 is adapted to be driven by a form feed gear 42 which is also supported on sidewall 12. A form idler gear 44 meshingly engages with the form feed gear 42 and rotation of the form feed idler gear 44 will effect rotation of the form feed gear 42 and gears 68 and 64 to effect rotation of the form feed roller 30. The stepper motor 56 is operatively associated with the form idler gear 44 and is operable to effect rotation thereof to drive form feed roller 30 as will be more fully described hereinbelow.

The motor 56 which is supported by the sidewall 12 of the printer mechanism 10 includes a drive shaft 70. A main drive gear 72 is fixed to the shaft 70 of the drive motor 56 to rotate therewith. An interposer shuttle 74 is supported on the drive shaft 70 of motor 56 and the main drive gear 72 is fixed to shaft 70. The interposer shuttle 74 is free to rotate around the drive motor shaft 70 and supports an interposer idler gear 76 which meshes with and is adapted to be driven by the main drive gear 72. The interposer idler gear 76 is adapted to be selectively engaged with the paper idler gear 26 or the form idler gear 44.

The interposer shuttle 74 is adapted to be rotated about drive shaft 70 to alternately engage with the paper feed idler gear 26 or the form feed idler gear 44 depending upon the direction of rotation of the main drive gear 72. When the main drive gear 72 is rotated in a first or clockwise direction as is illustrated in the Figures, the interposer shuttle 74 will be located in the position shown in FIG. 1 and the interposer idler gear 76 will engage with and drive the paper idler gear 26. The interposer idler 76 is driven into and held engaged with the paper feed idler gear 26 by the forces exerted by the clockwise rotation of the main drive gear 72 against the interposer idler 76 and by the drag of the drive motor shaft 70 on the interposer shuttle 74. Thus, when the drive motor 56 rotates the main drive gear 72 in a clockwise or first direction, the first print medium drive means which comprises the paper feed idler gear 26 and the paper feed gear 24 is driven to feed the continuous print medium 52 past the printhead 14 and the platen 16.

Figure 3:
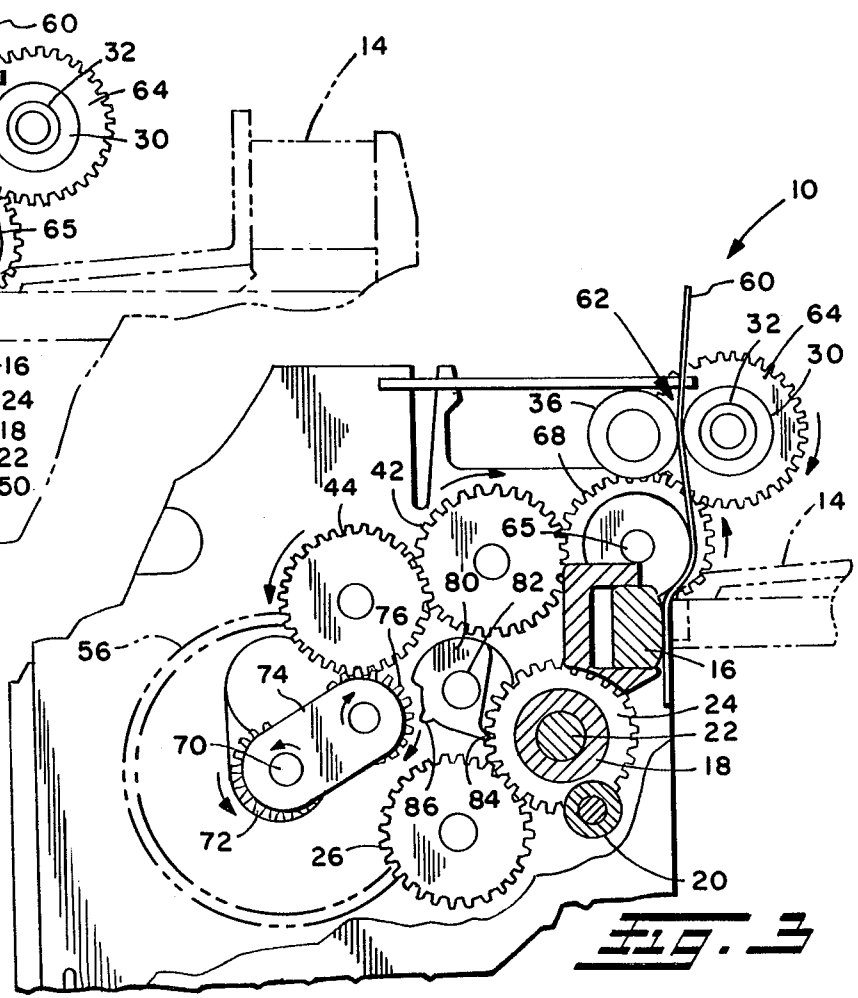
FIG. 3 is a schematic representation of the drive apparatus wherein the main drive gear is rotated further from its position shown in FIG. 2 in the second direction and the interposer idler fully engages with the forms drive means and the idler latch fully engages with and locks the paper drive means.
Figure 2:
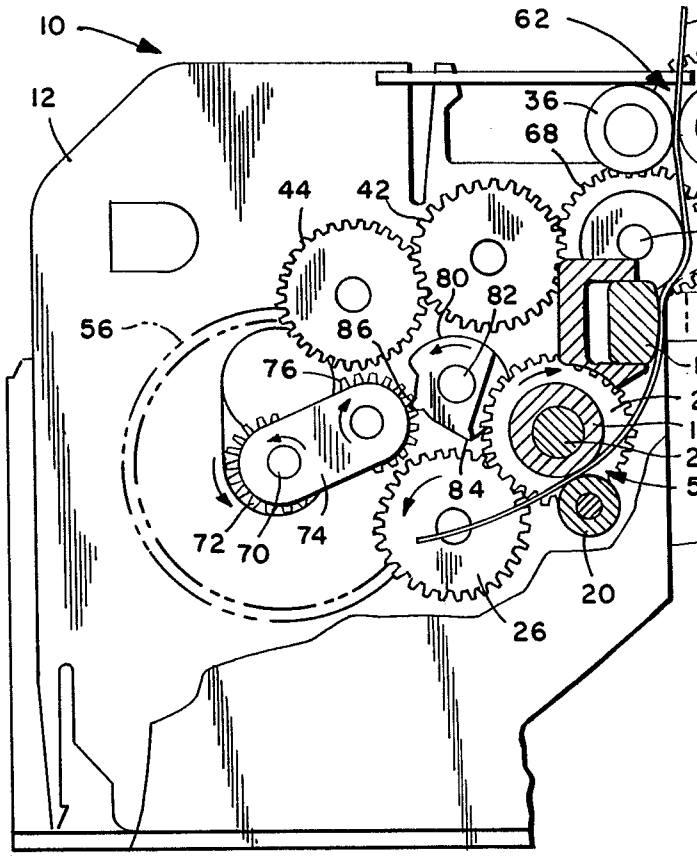
FIG. 2 is a schematic representation of the drive apparatus of the present invention in a position in which the main drive gear has initiated rotation in the second direction, opposite the direction of rotation disclosed in FIG. 1, and the interposer idler is disengaged from the paper drive means and is initially engaging with the idler latch.

If the drive motor 56 is reversed, main drive gear 72 is caused to rotate in a counterclockwise or second direction as is viewed in FIG. 1, the interposer shuttle 74 will be driven to revolve in a counterclockwise direction around the main drive gear 72 from its position illustrated in FIG. 1 through its position illustrated in FIG. 2 to its position shown in FIG. 3 and the interposer idler 76 will disengage from the paper feed idler gear 26 and engage with the form feed idler gear 44. When the interposer idler gear 76 is driven clockwise by the counterclockwise rotation of the main drive gear 72, as is illustrated in FIGS. 2 and 3, the interposer idler gear 76 will be driven to revolve counterclockwise around the drive motor gear 72 to engage with the form feed idler gear 44. Thus, when the main drive gear 72 is rotated in a second direction, opposite the first direction, (counterclockwise as viewed in the Figures) the interposer idler gear 76 will effect rotation of the second or form print medium drive train which comprises the form feed idler gear 44, the form feed gear 42 and the gear 68 and 64. This will effect feeding of a form 60 which is disposed in the nip 62 between the form feed roller 30 and the form feed pressure roller 36. When the form is driven through the nip 62 by the form feed roller 30, it will pass past the platen 16 and be adapted to be printed by the printhead 14.

A locking means or idler latch gear 80 is supported on a shaft 82 supported on the sidewall 12 of the printer mechanism 10. The idler latch gear 80 includes a pair of teeth 84 and 86. The tooth 84, when in its position illustrated in FIG. 3, is operable to engage with the teeth of the paper feed gear 24 to lock the paper feed gear 24 and the paper drive train from further rotation. The tooth 86 is operable to engage with the interposer idler gear 76 to rotate the idler latch 80 about shaft 82 to its position illustrated in FIG. 3. As used herein, the term revolution will mean the rotation of a part around some axis, e.g., the revolution of idler shuttle 74 about the axis of shaft 70 and the term rotation will mean the rotation of a part around the parts own axis, e.g., the rotation of idler latch 80 around the axis of shaft 82.

When the interposer idler shuttle 74 is in its position illustrated in FIG. 1 and the main drive gear 72 rotates in a clockwise direction, as is illustrated in FIG. 1, the idler latch 80 is spaced apart from the interposer idler gear 76 and the paper feed gear 24. When the main drive gear 72 is initially rotated, as is illustrated in FIG. 2, in a counterclockwise direction, it will effect clockwise rotation of the interposer idler gear 76 and counterclockwise revolution of the idler shuttle 74 about the motor shaft 70. When the interposer idler gear 76 is driven clockwise, it revolves counterclockwise around the drive motor shaft 70 as it meshes with the tooth 86 on the idler latch 80 and drives latch 80 counterclockwise as viewed in FIG. 2. As the idler latch gear 76 continues to revolve to its position shown in FIG. 3, rotation of the idler latch 80 in a counterclockwise direction continues until tooth 84 engages with the teeth of the paper feed gear 24. As tooth 84 engages with the teeth of the paper feed gear 24, tooth 86 disengages from the teeth of the interposer idler gear 76, as is illustrated in FIG. 3. When the interposer idler gear 76 is fully engaged with the form feed idler gear 44, the idler latch tooth 86 is out of mesh with the teeth of the interposer idler gear 76 and the tooth 84 is fully engaged with the paper feed gear 24 preventing its rotation and rotation of the paper feed drive train.

When the interposer idler gear 76 is driven into and held engaged with the paper feed idler gear 26, as illustrated in FIG. 1, the drive motor 56 may be stopped and electrically locked to prevent its rotation. When the drive motor 56 is electrically locked, the main drive gear 72 will be prevented from further rotation. When the drive motor 56 is electrically locked, any movement of the paper 52 which would require rotation of the paper feed idler gear 26 will be prevented by the drive gear 72 and the idler latch 80 which prevents gear 76 from moving out of mesh with gear 26. Any force which torques the paper feed idler gear 26 counterclockwise as viewed in the Figures will torque the interposer idler gear 76 clockwise which would rotate the interposer idler gear 76 and cause it to revolve clockwise around the main drive gear 72. However, the main drive gear 72 is locked and the paper feed idler gear 26 will prevent clockwise revolution of the interposer idler 76 and interposer shuttle 74 around the drive gear 72 thereby preventing paper movement. Any force which torques the paper feed idler gear 26 clockwise as viewed in the Figures will reverse the above reactions except that the idler latch 80 will prevent revolution of the interposer idler gear 76 about shaft 72 and hence prevent rotation of gear 76. The idler latch 80 is limited in its clockwise rotation by the paper feed gear 24 but allows clearance when the interposer idler 76 is fully engaged with the paper feed idler gear 26. The center to center distance between the drive gear 72 and the paper feed idler gear 26 is less than the sum of the center to center distance between the drive gear 72 and interposer idler gear 76 plus the distance between the interposer idler 76 and the paper feed idler 26. This prevents movement of the paper feed idler gear 26 in a counterclockwise direction.

When the interposer idler gear 76 is driven clockwise and revolves counterclockwise around the drive motor gear 72, it meshes with tooth 86 to drive idler latch 80 to drive it counterclockwise to lock the paper feed gear 24 with tooth. Thus, when the drive motor 56 is rotated in a first direction, the first print medium drive means for driving the paper 52 is driven and the form feed or second print medium drive means is de-energized. When the motor 56 is rotated in a second direction, opposite the first direction, the first print medium drive means for driving the paper 52 is locked by the idler latch 80 and the second print medium drive means for driving the form 60 is engaged and driven.

From the foregoing it should be apparent that a new drive apparatus for a printer mechanism 10 including a printhead 14 has been provided. The drive apparatus includes a first print medium drive means including the paper feed idler gear 26 and the paper feed gear 24 for feeding a first print medium 52 past printhead 14 and a second print medium drive means including the form idler gear 44, form feed gear 42 and gears 68 and 64 for feeding a second print medium such as the form 60 past the printhead 14. The drive apparatus further includes a main drive including the drive motor 56 and main drive gear 72 which is rotatable in a first direction for driving the first print medium drive means and which rotates in a second direction for driving the second print medium drive means. The drive apparatus includes a selectively engageable drive means including the interposer idler gear 76 which is operatively associated with the main drive gear 72 and which is alternately engageable with the paper feed idler gear 26 and the form feed idler gear 44. The selectively engageable drive means is operable to drive the first print medium drive means in a first direction when the main drive gear 72 is rotated in the first direction and is operable to drive the second print medium drive means in a second direction when the main drive gear 72 is rotated in the second direction. The drive apparatus further includes a locking means including the idler latch 80 which is operatively associated with the main drive gear 72 and is engageable with the first print medium drive means for preventing rotation of the paper feed gear 24 when the main drive gear 72 is rotated in its second direction. The main drive gear when rotated in its second direction actuates the locking means 80 to prevent rotation of the first print medium drive means in the first and second directions.

What is claimed is:

1. Drive apparatus for a printer mechanism including a printhead, comprising a first print medium drive means for feeding a first print medium past the printhead, a second print medium drive means for feeding a second print medium past the printhead, a main drive gear rotatable in a first direction for driving said first print medium drive means and rotatable in a second direction, opposite to said first direction, for driving said second print medium drive means, floating gear means operatively associated with said main drive gear and alternately engageable with said first print medium drive means and said second print medium drive means, said floating gear means driving said first print medium drive means in a first direction when said main drive gear is rotated in said first direction, said floating gear means driving said second print medium drive means in a second direction when said main drive gear is rotated in said second direction, and said main drive gear when rotated in said second direction effecting prevention of rotation of said first print medium drive means in said first and second directions.

2. Drive apparatus for a printer mechanism as defined in claim 1, further including locking means operatively associated with said main drive gear and engageable with said first print medium drive means for preventing rotation of said first print medium drive means when said main drive gear is rotated in said second direction.

3. Drive apparatus for a printer mechanism as defined in claim 2, wherein said locking means comprises a cam member engageable with said floating gear means, said cam member being engageable with said first print medium drive means to prevent rotation thereof in said first and second directions when said main drive gear is rotated in said second direction.

4. Drive apparatus for a printer mechanism as defined in claim 3, wherein said cam member comprises a cam gear for engaging with said floating gear means and said first print medium drive means when said main drive gear is rotated in said second direction.

5. Drive apparatus for a printer mechanism as defined in claim 1, further including support means for floatingly supporting said floating gear means, said support means being moveable between a first position in which said floating gear means engages and is operable to drive said first print medium drive means and is spaced apart from said second print medium drive means and a second position in which said floating gear means engages and is operable to drive said second print medium drive means and is spaced apart from said first print medium drive means.

6. Drive apparatus for a printer mechanism as defined in claim 5, wherein said first print medium drive means includes a first idler gear and a first print medium drive gear engageable with said first idler gear and said second print medium drive means includes a second idler gear and a second print medium drive gear engagable with said second idler gear.

7. Drive apparatus for a printer mechanism as defined in claim 6, wherein said floating gear means is alternately engageble with said first idler gear and said second idler gear.

8. Drive apparatus for a printer mechanism as defined in claim 5, wherein said floating support means is operably associated with said main drive gear, said main drive gear when rotated in said first direction effecting movement of said floating support means and said floating gear supported thereby to said first position in which said floating gear is operable to engage and drive said first print medium drive means, said main drive gear when rotated in said second direction effecting movement of said floating support means and said floating gear supported thereby to said second position in which said floating gear is operable to drive said second print medium drive means.

9. Drive apparatus for a printer mechanism including a printhead, comprising a first print medium drive means for feeding a first print medium past the printhead, a second print medium drive means for feeding a second print medium past the printhead, a main drive rotatable in a first direction for driving said first print medium drive means and rotatable in a second direction, opposite to said first direction, for driving said second print medium drive means, selectively engagable drive means operatively associated with said main drive and alternately engageable with said first print medium drive means and said second print medium drive means, said selectively engagable drive means driving said first print medium drive means in a first direction when said main drive is rotated in said first direction and driving said second print medium drive means in a second direction when said main drive is rotated in said second direction, and locking means operatively associated with said main drive and engageable with said first print medium drive means for preventing rotation of said first print medium drive means when said main drive is rotated in said second direction, said main drive when rotated in said second direction actuating said locking means to prevent rotation of said first print medium drive means in said first and second directions.

10. Drive apparatus for a printer mechanism as defined in claim 9, wherein said selectively engageable drive means includes a floating gear and a floating support means for supporting said floating gear, said floating support means being operably associated with said main drive, said main drive when rotated in said first direction effecting movement of said floating support means and said floating gear supported thereby to a first position in which said floating gear is operable to engage and drive said first print medium drive means, said main drive when rotated in said second direction effecting movement of said floating support means and said floating gear supported thereby to a second position in which said floating gear is operable to drive said second print medium drive means.

11. Drive apparatus for a printer mechanism as defined in claim 10, wherein said locking means comprises a cam member engageable with said floating gear, said cam member being engageable with said first print medium drive means to prevent rotation thereof in said first and second directions when said main drive is rotated in said second direction.

12. Drive apparatus for a printer mechanism as defined in claim 11, wherein said cam member comprises a cam gear for engaging with said floating gear means and said first print medium drive means when said main drive is rotated in said second direction.

* * * * *